US006258213B1

(12) United States Patent
Fagerlund et al.

(10) Patent No.: US 6,258,213 B1
(45) Date of Patent: Jul. 10, 2001

(54) REGULATION SYSTEM IN A PAPER MACHINE FOR CONTROLLING VARIATION OF THE BASIS WEIGHT OF THE PAPER IN THE MACHINE DIRECTION

(75) Inventors: John Fagerlund; Harri Mustonen; Harri Vähätalo, all of Jyväskylä(FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/263,398

(22) Filed: Mar. 5, 1999

Related U.S. Application Data

(62) Division of application No. 08/818,833, filed on Mar. 14, 1997, now Pat. No. 5,944,957.

(51) Int. Cl.[7] ..... D21H 11/00; D21H 13/00

(52) U.S. Cl. ..... 162/198; 162/190; 162/DIG. 11; 700/129; 700/128

(58) Field of Search ..... 162/198, 252, 162/190, 189, 183, 253, 258, 259, DIG. 10, DIG. 11, 343, 336; 364/469.01, 471.01–471.03, 474.09; 700/127–129

(56) References Cited

U.S. PATENT DOCUMENTS

| | | | | |
|---|---|---|---|---|
| 3,562,104 | | 2/1971 | Taylor | 162/259 |
| 3,619,360 | | 11/1971 | Persik, Jr. | 162/228 |
| 3,649,444 | | 3/1972 | Futch, Jr. | 162/258 |
| 3,666,621 | * | 5/1972 | Adams | 162/198 |
| 3,676,295 | * | 7/1972 | Rice | 162/198 |
| 3,981,767 | | 9/1976 | Al-Shaikh | 162/258 |
| 5,196,091 | | 3/1993 | Hergert | 162/258 |
| 5,549,793 | | 8/1996 | Hellstrom et al. | 162/198 |
| 5,603,806 | | 2/1997 | Kertulla | 162/198 |
| 5,611,891 | | 3/1997 | Hundley, III | 162/198 |
| 5,674,363 | * | 10/1997 | Huovila et al. | 162/216 |
| 5,800,678 | * | 9/1998 | Pitkajarvi | 162/199 |
| 5,814,191 | * | 9/1998 | Huovila | 162/216 |
| 5,843,281 | * | 12/1998 | Huovila | 162/216 |
| 5,853,545 | * | 12/1998 | Haraldsson et al. | 162/343 |

OTHER PUBLICATIONS

"Introduction to Control Theory with Applications to Process Control", Lowell B. Koppel, Prentice–Hall, Inc., 1968, pp. 23–33.

* cited by examiner

*Primary Examiner*—Jose Fortuna
(74) *Attorney, Agent, or Firm*—Steinberg & Raskin, P.C.

(57) ABSTRACT

Regulation method in a paper machine for controlling the variation of the basis weight of a paper web in the machine direction in which the basis weight profile of the web is measured by means of a measurement device and a basis weight regulation system receives a signal of the measurement of the basis weight from the measurement device and generates a regulation signal for controlling the flow of thick stock passed into a short circulation circuit in the paper machine by a basis weight valve and/or a regulation pump. The variation of the basis weight in the machine direction in the paper machine is controlled, besides by the short circulation circuit of regulation, also by a substantially faster second circuit of regulation which comprises one or more actuators for controlling the flow rate of the dilution water flow in the dilution profiling system of the headbox and/or the consistency of the dilution water flow across the entire width of the paper web.

14 Claims, 4 Drawing Sheets

REGULATION SYSTEM IN A PAPER MACHINE FOR CONTROLLING VARIATION OF THE BASIS WEIGHT OF THE PAPER IN THE MACHINE DIRECTION

CROSS-REFERENCE TO RELATED APPLICATION

This application is a divisional of U.S. patent application Ser. No. 08/818,833 filed Mar. 14, 1997 now U.S. Pat. No. 5,944,957.

FIELD OF THE INVENTION

The present invention relates to a method for controlling the variation of the basis weight of a paper web in the machine direction in which the basis weight of the dried web is measured and the flow of thick stock into a wire pit containing white water from the paper machine is controlled based on the measured basis weight of the web whereby a mixed flow of the thick stock and white water is passed into a headbox of the paper machine.

The present invention also relates to a regulation method in a paper machine for controlling the variation of the basis weight of a paper web in the machine direction, in which the basis weight profile of the paper web is measured by means of a measurement device. A basis weight regulation system receives the signal of the measured basis weight from the measurement device and generates a regulation signal by whose means the flow of thick stock passed into the short circulation in the paper machine is regulated by means of an actuator, such as a basis weight valve and/or a regulation pump.

BACKGROUND OF THE INVENTION

As is known in the prior art, the systems of regulation of the machine-direction basis weight of the paper produced by means of paper machines operate as follows. The flow of the thick stock entering into the wire pit is regulated by means of a basis weight valve based on the measurement of the basis weight in the dry end of the paper machine. The basis weight of the paper web is measured by means of measurement detectors traversing in its cross direction, and the result of measurement of the cross-direction basis weight profile is produced as an average value and passed into the system of regulation as a feedback signal. From the basis weight valve, the flow of thick stock is passed, in a manner known in the prior art, into the wire pit and into which wire pit, the wire waters are also passed from the wire part of the paper machine. In the wire pit, the thick stock flow and the wire waters are mixed together, and the diluted stock flow thus obtained is passed, in a manner in itself known, through stock cleaning and deaeration devices into the inlet header in the headbox and from there further through the distributor manifold, possible stilling chamber and the turbulence generator of the headbox into a slice duct of the headbox. Out of the slice duct, the stock suspension jet is discharged onto a forming wire or into a forming gap defined between a pair of forming wires.

In the prior art, the cross-direction basis weight profile of the paper produced by means of paper machines is often regulated by means of profiling of the height of the slice opening based on the measurement of basis weight taking place in the dry end of the paper machine and described above. In recent years, what is called dilution regulations have also become more common, in which a dilution medium, typically wire water or clear filtrate or, in exceptional cases, a stock more dilute than the stock in the headbox, is fed into discrete feed points separate in the cross direction in connection with the headbox. By means of this dilution water feed system, the cross-direction basis weight profile of the slice jet is profiled together with, or without, regulation of the top slice bar. It is a particular advantage of the dilution regulation that the headbox can be run with a slice opening at a uniform height, so that the cross-direction flows in and after the slice jet, arising from the profiling of the height of the slice opening, and the distortions in the fiber orientation profile in the paper, as a result of such cross-direction flows, can be substantially avoided.

It is the most pronounced drawback of the prior art systems of regulation that monitor the machine-direction basis weight profile of paper that the response time of the system of regulation is very long. The delay in these systems of regulation from the actuator to the basis weight measurement point consists of the delay caused by the stock flow from the wire pit to the headbox and of the time of the passage of the paper web from the headbox to the measurement frame in the dry end of the machine. The magnitude of the delay depends on the stock flow velocity in the pipe system of the short circulation and on the machine speed.

The dead time in this type of system of regulation is typically of an order of one minute. Further, the regulation is made slower by the fact that, after a change in the position of the basis weight valve, reaching of a stable situation requires equalization of the consistencies in the entire short circulation. The time constant arising from this in the process is typically several dozens of seconds.

The long dead time and the time constant restrict the operation of this system of regulation as follows:

- In a stable running situation, the regulation is capable of eliminating variations of very long cycles only. As a rough upper limit are considered disturbances of a cycle of 100 seconds, but in practice even this estimate is in most cases clearly excessively optimistic.
- In situations of change in the basis weight, such as change of paper grade, reaching a new stable situation takes a long time.
- Optimal tuning of the regulation is difficult, because the dead time varies in compliance with the process conditions, and it cannot be predicted precisely by means of computing in different situations.

OBJECTS AND SUMMARY OF THE INVENTION

Accordingly, it is an object of the present invention to provide a method of regulation in a paper machine by whose means expressly the machine-direction basis weight profile of the paper produced by means of the paper machine can be regulated more favorably than in the prior art so that the drawbacks discussed above can be substantially avoided.

It is a specific object of the present invention, in a novel and inventive way, to combine the prior art method of regulation of the cross-direction basis weight profile of paper based on dilution of the stock flow in the headbox and a method of regulation of the machine-direction basis weight profile.

It is another object of the present invention to provide a new and improved method for controlling the basis weight profile of a fibrous and/or material web.

In view of achieving the objects stated above and others, in the invention, the system of regulation used in the regulation method includes control means for controlling the variation of the basis weight in the machine direction in the paper machine, besides by means of a slow circuit of regulation-the use of a basis weight actuator to control the flow of thick stock into the wire pit, also by means of a substantially quicker second circuit of regulation which comprises an actuator or actuators and is associated with the dilution profiling system of the headbox. By means of these actuators, the level or flow rate of the dilution water flow in the dilution profiling system of the headbox and/or the consistency of the dilution water flow is/are controlled across the entire width of the paper web.

According to the invention, the regulation of the machine-direction basis weight profile is not accomplished exclusively by means of the system of regulation of the headbox, but in combination with regulation of a prior art basis weight valve or equivalent. In the invention, by means of the headbox, controlled changes are made in the overall dilution, i.e., in the level of dilution extending across the entire width of the paper web, by means of which controlled changes some of the slowness related to the regulation of the basis weight valve is compensated for.

Owing to the system of regulation in accordance with the invention, the dead time of the process can be reduced typically to about 20 seconds. Moreover, the detrimental effect of the time constant arising from the stabilization of the consistencies can be reduced substantially by connecting the regulation with measurement of the consistency of the stock entering into the headbox. This measurement can be used as a feedforward control for the dilution regulation, in which case, in a situation of change, the headbox consistency can be stabilized quickly in spite of the slowness caused by the large total volume of the short circulation.

From the point of view of regulation, it is also an advantage that the delay between the actuator for the dilution proportion of the headbox and the measurement of basis weight can be predicted considerably more accurately than the corresponding delay from the basis weight valve to the basis weight measurement frame, which frame is placed after the dryer section of the paper machine.

With respect to the theoretical background of the feedforward circuit or circuits of regulation, which may possibly be applied in the present invention, reference is made to the paper by Lowell B. Koppel, "Introduction to Control Theory with Applications to Process Control", Prentice-Hall, Inc., Chapter 1, pp. 23–25.

An embodiment of the method in accordance with the invention for controlling variation of the basis weight of a paper web in the machine direction includes the steps of measuring the basis weight of the dried web, e.g., after the dryer section, and controlling the flow of thick stock into a wire pit containing white water from the paper machine based on the measured basis weight of the web whereby a mixed flow of the thick stock and white water is passed into a headbox of the paper machine. A first variable diluting flow is directed into the headbox, possibly into the mixed flow of the thick stock and white water being passed in the headbox, across substantially the entire width of the web, and the level (flow rate) of the first diluting flow and/or the consistency of the first diluting flow is controlled across substantially the entire width of the web based on the measured basis weight of the dried web. In certain embodiments, a second diluting flow is passed into the mixed flow of the thick stock and white water being passed into the headbox, the consistency of the mixed flow after a mixing point of the second diluting flow and the mixed flow is measured, and the level of the second diluting flow is controlled based at least in part on the measured consistency of the mixed flow after the mixing point (i.e., feedback regulation circuit). In addition to or instead of this regulation, the consistency of the mixed flow before the mixing point of the second diluting flow and the mixed flow is measured, and the level of the second diluting flow is controlled based at least in part on the measured consistency of the mixed flow before the mixing point.

In other embodiments of the method, a second diluting flow may be directed into connection with the first diluting flow to form a combined diluting flow, the consistency of the combined diluting flow being passed into the headbox is measured after a mixing point of the first diluting flow and the second diluting flow, and the level (flow rate) and/or consistency of the second diluting flow being directed to the mixing point is regulated based on the measured consistency of the combined diluting flow. It is also possible to measure the consistency of the combined diluting flow being passed into the headbox before a mixing point of the first diluting flow and the second diluting flow, and regulate at least one of the flow rate and consistency of the second diluting flow being directed to the mixing point based on the measured consistency of the combined diluting flow.

Furthermore, in certain embodiments of the method in accordance with the invention, the consistency of the stock flow entering into the headbox and the consistency of the first diluting flow entering into the headbox are measured, and the level or flow rate of the first diluting flow and/or the consistency of the first diluting flow is controlled based at least in part on the measured consistency of the stock flow entering into the headbox and the measured consistency of the first diluting flow.

In the following, the invention will be described in detail with reference to some exemplifying embodiments of the invention illustrated in the figures in the accompanying drawing. However, the invention is by no means strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
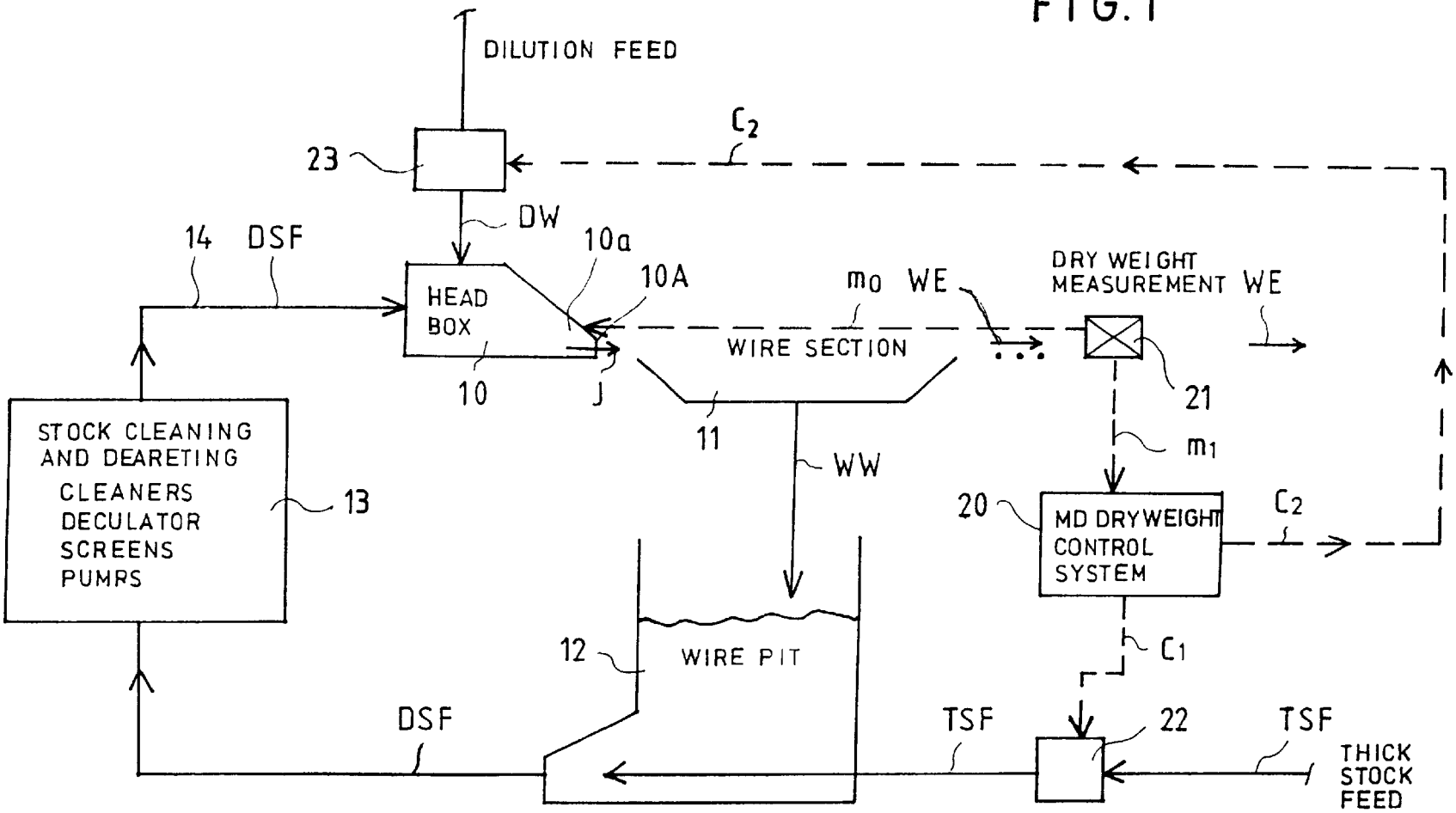
FIG. 1 is a schematic illustration, mainly as a block diagram, of the system of regulation in accordance with the invention and its connection with the paper machine and its stock feed system.

Referring to FIGS. 1–4 wherein like reference numerals refer to the same or similar elements, FIG. 1 is a schematic illustration of the system of regulation in accordance with the present invention and its connection with the paper machine and its stock feed system. The paper machine comprises a headbox 10 including a slice duct 10*a* having a slice opening 10A from which a stock suspension jet J is fed onto a wire in the wire part 11 of the paper machine. In the paper machine, the wire part 11 is followed by the press section and the dryer section (not shown). The ready dried paper web WE runs past a basis weight measurement device 21 which measures its basis weight. This measurement may take place after the web has been dried to its final basis weight after the dryer section. From the basis weight measurement device 21, a measurement signal $m_0$ for the cross-direction basis weight profile of the web WE is obtained, which signal can, if necessary and/or desired, be passed to the regulation system of the height profile of the slice opening 10A of the headbox 10.

The result of measurement of the cross-direction basis weight profile obtained from the measurement device 21 may be processed by computational means to produce an average value, and whereby the measurement signal $m_1$ of the machine-direction profile is obtained. This signal $m_1$ is passed to a system 20 of regulation of the machine-direction basis weight. From the regulation system 20, the regulation signal $c_1$ is obtained (i.e., the average value of the basis weight determines the regulation signal) and used to control a basis weight valve 22 of the thick stock flow TSF. Instead of regulating the basis weight valve 22 by means of the signal $c_1$, it is also possible to regulate the speed of rotation of the pump (not shown) that feeds the thick stock flow TSF. The thick stock flow TSF, whose quantity has been regulated by means of the valve 22, is fed into a wire pit 12 of the short circulation in the paper machine, into which wire pit the wire water flow WW drained from the paper web in the wire part 11 is passed. In the wire pit 12, the thick stock flow TSF and the wire water flow WW are mixed together. From the wire pit 12, a diluted stock flow DSF departs, which is passed through a stock cleaning and deaeration unit 13 and through a stock pipe 14 into the inlet header of the headbox 10.

As shown in FIG. 1, in the manner known from the prior art, regulated dilution water flows DW are passed into the headbox 10 into separate flow points in the cross direction of the headbox. By means of the flows DW, the cross-direction basis weight profile of the stock suspension jet J is controlled, possibly together with regulation of the cross-direction profile of the slice opening 10A of the headbox 10 (possibly in association with measurement signal $m_0$) or, preferably, without this regulation, in which case a favorable slice opening 10A of uniform height is used.

According to the present invention, the regulation of the machine-direction basis weight profile in the paper machine is accomplished in the manner shown in FIG. 1 by passing a regulation signal $c_2$ from the basis weight regulation unit 20 to an appropriate actuator 23 which regulates the diluting flows DW. More specifically, by means of the actuator 23, the level of the quantity of the dilution flow DW passing into the headbox 10 may be changed across the entire width of the headbox 10 and the web WE. The regulation signal $c_2$ is generated based on the measured basis weight of the web, for example, as represented by the first measurement signal from the measurement device 21, although it may be based on a measurement of the basis weight obtained in a different manner possibly by a different measuring unit.

Figure 2:
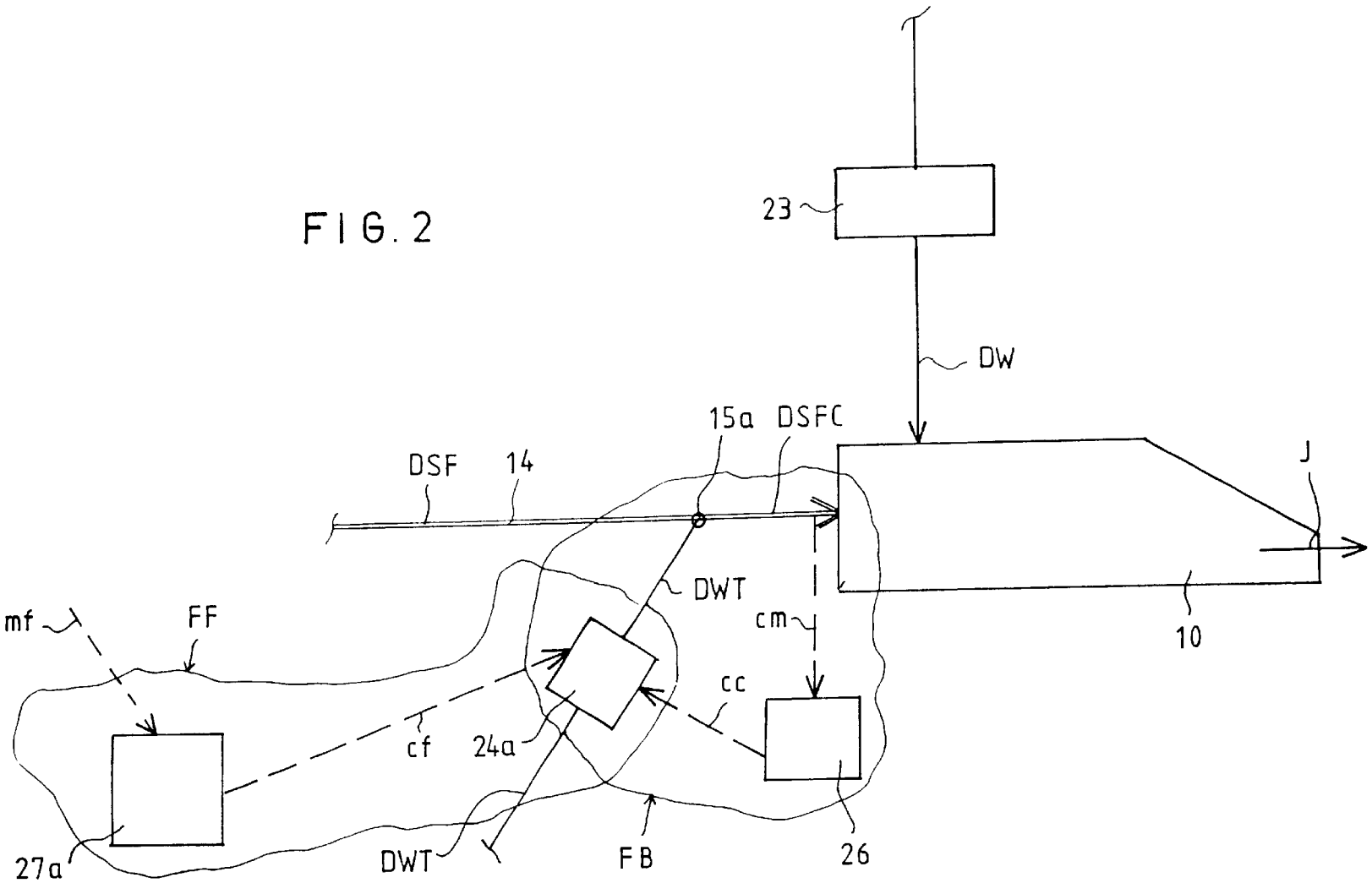
FIG. 2 is a schematic illustration in part of FIG. 1, being a more detailed illustration of a first embodiment of the invention.
Figure 3:
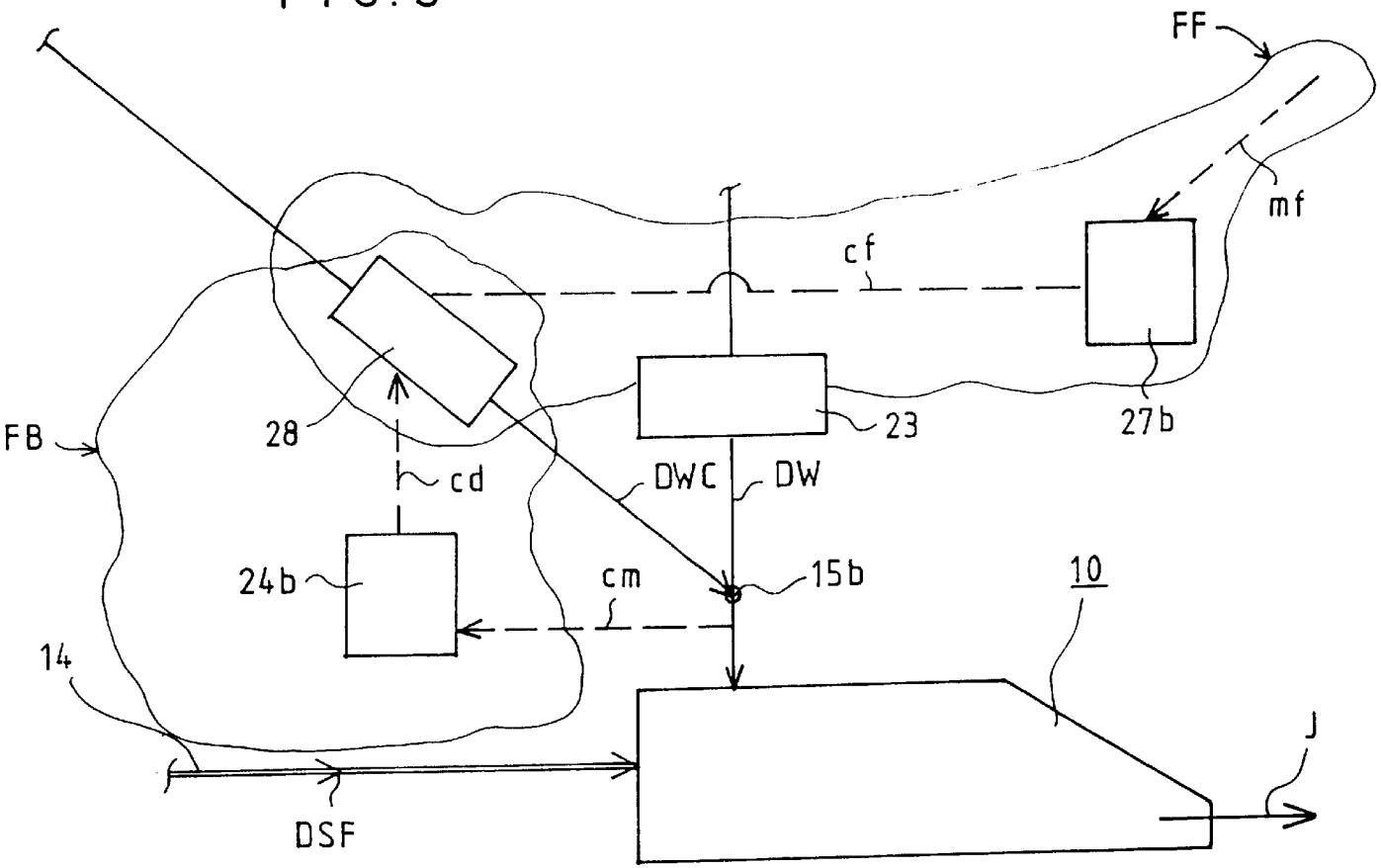
FIG. 3 is a schematic illustration in part of FIG. 1, being a more detailed illustration of a second embodiment of the invention.

FIGS. 2 and 3 are more detailed illustrations in part of FIG. 1, and are block diagrams illustrating two preferred embodiments of the invention.

In FIG. 2, the feedback part of the regulation system is denoted by FB and the feedforward part of the regulation system is denoted by FF. In the feedback regulation circuit FB, rapid regulation of the consistency of the stock flow DSF fed into the headbox 10 (which constitutes a mixture of the thick stock flow TSF and the wire water flow WW) is carried out by means of separate dilution at the mixing point 15*a*, to which point, in view of regulation of the overall consistency of the stock flow fed into the headbox 10, a dilution flow DWT is fed, which flow is regulated by means of the actuator 24*a*. This actuator 24*a* is regulated by means of a feedback regulation signal cc, which is formed based on the signal cm of measurement of the consistency of the regulated stock flow DSFC after the mixing point 15*a*. The actuator 24*a* is, for example, a valve that regulates the dilution flow of the headbox stock or a corresponding regulation pump.

As shown in FIG. 2, the feedforward regulation circuit FF includes measurement devices 27*a*, by whose means the consistency of the short circulation of the main stock flow of the headbox is measured before the mixing point 15*a* (represented by the notation mf), whereby the regulation is made quicker. A regulation signal cf is generated by the measurement devices 27*a* and utilized to regulate the actuator 24*a* either alone, if the feedback circuit is not present, or in conjunction with the regulation of the actuator 24*a* determined by the feedback regulation signal cc.

The feedback regulation circuit FB and the feedforward regulation circuit FF, which are shown in FIG. 2, can be used either separately or together as a combination in view of obtaining an optimal regulation result.

The regulation circuit shown in FIG. 3 has a construction in other respects similar to that described above in relation to FIGS. 1 and 2 except that, instead of or in addition to the regulation of the consistency of the headbox stock, the consistency of the dilution water flow DW used for cross-direction consistency profiling in the headbox is regulated by means of a feedback regulation circuit FB and/or by means of a feedforward regulation circuit FF. In this system of dilution of the dilution water flow DW, as the dilution water it is possible to use clear filtrate or any other water that does not contain solid matter.

As shown in FIG. 3, the feedback regulation circuit FB includes an actuator 28, which is, for example, an actuator 28 which is used for dilution of the dilution water flow DW, i.e., an actuator that regulates the flow DWC used for regulation of the consistency, for example a pump or a valve. There is thus not only the principal diluting flow DW being passed to the headbox but also a secondary diluting flow DWC being passed into the principal diluting flow DW. In connection with the actuator 28, a regulator 24*b* is arranged and receives a regulation signal cm from the measurement detectors of the consistency of the mixed dilution flow DW after the mixing point 15*b* at which the diluting flows DW and DWC are combined. The regulator 24*b* passes the regulation signal cd to the actuator 28, and in this manner, a feedback regulation circuit FB for the flow DW consistency is formed.

The feedforward regulation circuit FF shown in FIG. 3 includes a regulator 27*b*, which receives a measurement signal mf from an earlier stage in the dilution system before the mixing point 15*b* so as to make the regulation quicker. From the regulator 27*b*, a regulation signal cf is passed to an actuator 28, which operates as an actuator both in the feedforward regulation circuit FF and in the feedback regulation circuit FB. The feedforward regulation circuit FF and the feedback regulation circuit FB can be used either independently of one another or together as a combination.

Figure 4:
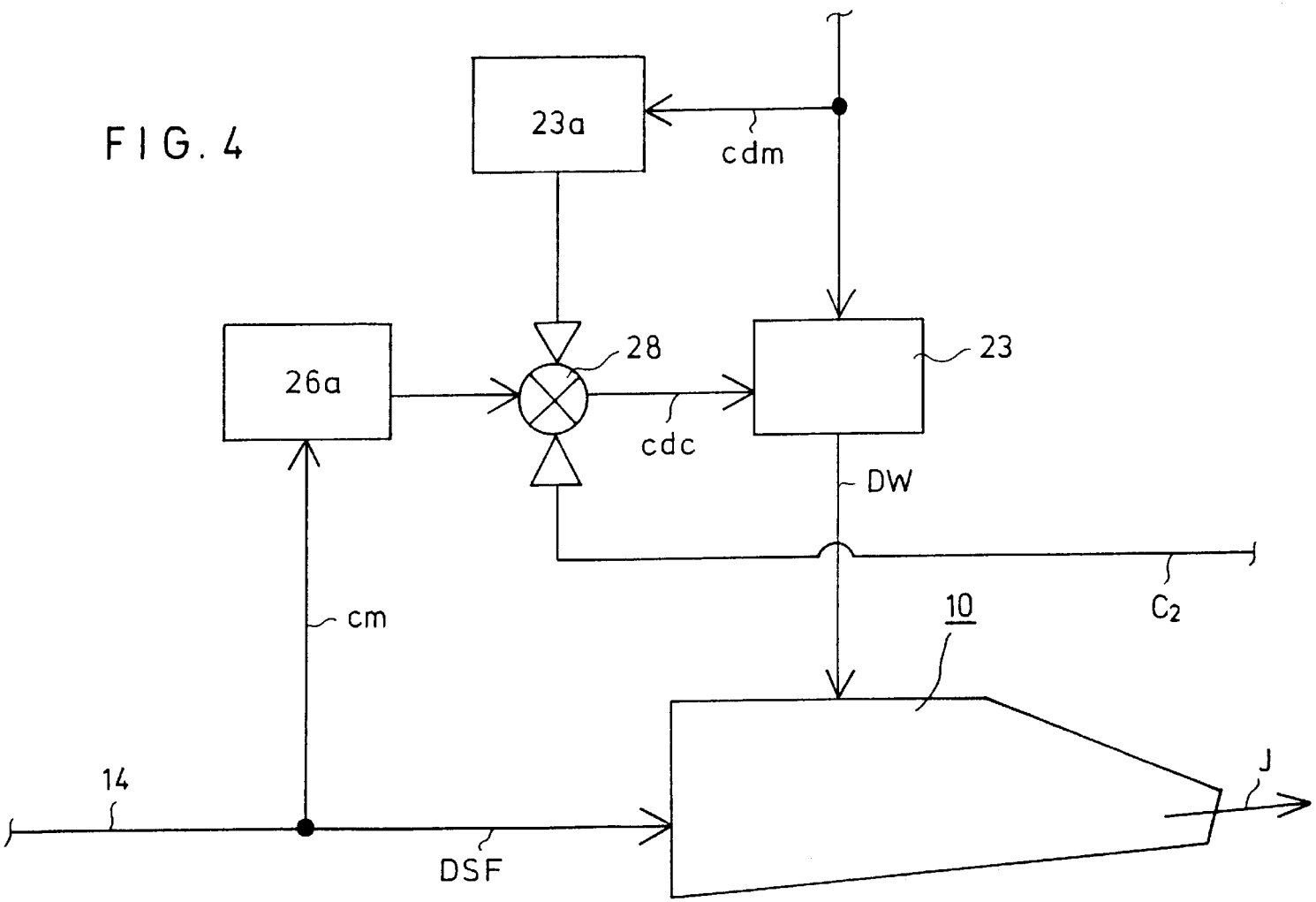
FIG. 4 is a schematic illustration of a third exemplifying embodiment of the invention.

In the exemplifying embodiment shown in FIG. 4, the consistency of the stock flow DSF (the combination of the thick stock flow TSF and the wire water flow WW) entering into the headbox 10 is measured by appropriate measuring means which generate a measurement signal cm. The measurement signal cm thus obtained is passed to the regulation unit 26*a*. Further, the consistency of the dilution water flow DW is measured by appropriate measuring means, and the measurement signal cdm thus obtained is passed to the regulation unit 23*a*. From the units 23*a* and 26*a*, regulation signals are passed to a summing/difference member 28, to which the regulation signal $c_2$ described above is also passed, which signal is received from the basis weight regulation unit 20. From the member 28, the regulation signal cdc is obtained, which is passed to the actuator 23 that regulates the quantity of the dilution flow DW. By means of the regulation circuit described above, any disturbance that may occur in the consistency of the stock flow DSF is compensated for by changing the dilution flow DW.

The principle of operation of the regulation circuit illustrated in FIG. 4 is substantially the same as that of the circuit illustrated in FIG. 2, but in the regulation circuit shown in FIG. 4, a separate mixing point 15*a* placed in the approach pipe 14 is not used, but the consistency after the dilution stage is affected directly in the headbox. Since measurement of the overall consistency from the slice duct is very difficult in practice, the regulation circuit shown in FIG. 4 operates with the FF principle.

Of the regulation circuit illustrated in FIG. 4, such a variation is also applicable in which the signal cdm of measurement of the consistency of the dilution flow DW is produced from the dilution flow DW after the actuator 23. By means of the measurement signal cdm, additional information is obtained for predicting the consistency in the slice duct of the headbox 10 by means of the FB or FF principle.

It should be noticed in particular that a permanent change in the basis weight is not achieved by means of a change in the dilution quantity alone. This comes from the fact that, in a state of equilibrium, the quantity of dry solids (dry weight) that remains in the paper web WE depends exclusively on the quantity of solid matter that is fed into the wire pit 12, i.e., in a state of equilibrium the same quantity of solid matter departs along with the paper web W as is fed through the thick stock line into the wire pit 12. Thus, it is possible to change the basis weight of the web WE permanently exclusively by changing the flow rate or the consistency of the thick stock. The mode of regulation in accordance with the present invention can, however, be utilized so that the dilution quantity and the feed of thick stock are controlled at the same time so that an optimal result of regulation, i.e., the quickest response in relation to the basis weight, is achieved.

The examples provided above are not meant to be exclusive. Many other variations of the present invention would be obvious to those skilled in the art, and are contemplated to be within the scope of the appended claims.

We claim:

1. A method for controlling variation of the basis weight of a paper web in the machine direction comprising the steps of:

measuring the basis weight of the web after the dryer section for obtaining a machine direction basis weight profile, controlling the flow of thick stock into a wire pit containing white water from the paper machine based on said measured basis weight of the web whereby a mixed flow of the thick stock and white water is passed into a headbox of the paper machine, directing a first variable diluting flow into the headbox across substantially the entire width of the web, and controlling at least one of the flow rate and consistency of the first diluting flow across substantially the entire width of the web based on said measured basis weight of the web after the dryer section, in order to regulate the basis weight profile in the machine direction.

2. The method of claim 1, wherein the flow rate of the first diluting flow across substantially the entire width of the web is controlled.

3. The method of claim 1, wherein the consistency of the first diluting flow across substantially the entire width of the web is controlled.

4. The method of claim 1, wherein the flow rate and the consistency of the first diluting flow across substantially the entire width of the web is controlled.

5. The method of claim 1, further comprising the step of:

passing a second diluting flow into the mixed flow of the thick stock and white water being passed into the headbox.

6. The method of claim 5, further comprising the steps of:

measuring the consistency of the mixed flow after a mixing point of the second diluting flow and the mixed flow, and controlling the flow rate of the second diluting flow based at least in part on the measured consistency of the mixed flow after the mixing point.

7. The method of claim 5, further comprising the steps of:

measuring the consistency of the mixed flow before the mixing point of the second diluting flow and the mixed flow, and controlling the flow rate of the second diluting flow based at least in part on the measured consistency of the mixed flow before the mixing point.

8. The method of claim 1, further comprising the step of:

directing a second diluting flow into connection with the first diluting flow to form a combined diluting flow.

9. The method of claim 8, further comprising the steps of:

measuring the consistency of the combined diluting flow being passed into the headbox after a mixing point of the first diluting flow and the second diluting flow, and regulating at least one of the flow rate and consistency of the second diluting flow being directed to the mixing point based on the measured consistency of the combined diluting flow.

10. The method of claim 8, further comprising the steps of:

measuring the consistency of the combined diluting flow being passed into the headbox before a mixing point of the first diluting flow and the second diluting flow, and regulating at least one of the flow rate and consistency of the second diluting flow being directed to the mixing point based on the measured consistency of the combined diluting flow.

11. The method of claim 1, further comprising the steps of:

measuring the consistency of the stock flow entering into the headbox, measuring the consistency of the first diluting flow entering into the headbox, and controlling at least one of the flow rate and the consistency of the first diluting flow based at least in part on the measured consistency of the stock flow entering into the headbox and the measured consistency of the first diluting flow.

12. The method of claim 11, wherein the flow rate of first diluting flow is controlled.

13. The method of claim 11, wherein the consistency of the first diluting flow is controlled.

14. The method of claim 11, wherein both the flow rate and the consistency of the first diluting flow are controlled.

* * * * *